US006129441A

United States Patent [19]

Wu et al.

[11] Patent Number: 6,129,441

[45] Date of Patent: Oct. 10, 2000

[54] OFFICE FURNITURE LIGHT STRUCTURE

[76] Inventors: Yu-Chi Wu, No. 13-1, Lane 130, Hochiang St.; Chen Tsao, No. 173-2, Lane 120, Hulin St., both of Taipei, Taiwan

[21] Appl. No.: 09/312,958

[22] Filed: May 17, 1999

[51] Int. Cl.[7] ..... F21W 131/301

[52] U.S. Cl. ..... 362/127; 362/133; 362/285; 362/287; 362/419; 362/427

[58] Field of Search ..... 362/127, 133, 362/134, 285, 287, 418, 419, 421, 422, 427, 428, 430

[56] References Cited

U.S. PATENT DOCUMENTS

| | | | |
|---|---|---|---|
| 517,569 | 4/1894 | Garlock et al. | 362/127 |
| 518,713 | 4/1894 | Connell | 362/133 |
| 1,532,935 | 4/1925 | Patton | 362/133 |
| 4,164,009 | 8/1979 | Maguire, Jr. et al. | 362/127 |
| 4,454,569 | 6/1984 | Maguire | 362/127 |
| 6,004,005 | 12/1999 | Demshki, Jr. | 362/287 X |

*Primary Examiner*—Laura K. Tso
*Attorney, Agent, or Firm*—Bacon & Thomas, PLLC

[57] ABSTRACT

An office furniture light structure includes a securing element adapted for mounting on a piece of office furniture in a suitable position, and a lighting device. The securing element is provided with at lest one outwardly extending movable element. The movable element has a distal end connected to the lighting device in a movable manner. In use, the lighting device can be moved to a suitable position by means of the movable element to sufficiently illuminate a place.

6 Claims, 5 Drawing Sheets

OFFICE FURNITURE LIGHT STRUCTURE

BACKGROUND OF THE INVENTION (a) Field of the Invention

The present invention relates to an office furniture light structure, more particularly to a lighting device that can be moved to a suitable position on a piece of office furniture to provide sufficient illumination.

(b) Description of the Prior Art

With reference to FIG. 1, in an office where the main source of light comes from ceiling lighting fixtures, the area beneath a shelf 1 and a table surface 11 is relatively dark. In general, a conventional lighting device 13 (e.g., a fluorescent lamp) is mounted on a bottom side of the shelf 1 to illuminate that area. However, as the lighting device 13 can only mounted at a fixed position and is not removable, the lighting zone is restricted to that below the lighting device 13. The other dark areas or zones are not properly illuminated. Improvements are therefore necessary.

SUMMARY OF THE INVENTION

In the present invention, a securing element is adapted to be mounted on a piece of office furniture in a suitable position. The securing element is provided with at least one outwardly extending movable element. The movable element has one end connected to a lighting device in a movable manner. In use, through displacement of the movable element, the lighting device can be moved to a suitable position.

A primary object of the present invention is to provide an office furniture light structure that includes a securing rail that has two ends respectively provided with an outwardly extending movable plate. The movable plates have one end insertably disposed in a track of the securing rail by means of rollers. A lighting device is movably connected to the other end of each of the movable plates. In use, by means of the rollers displacing in the track of the securing rail, the lighting device can displace left and right. Besides, by means of the movable plates, the lighting device can be pulled outwardly or pushed inwardly with respect to a bottom side of a shelf to sufficiently illuminate the area beneath the shelf which is relatively dark.

Another object of the present invention is to provide an office furniture light structure that includes a fixed slide rail and outwardly extending movable slide rails provided at both ends of the fixed slide rail. The movable slide rails are connected to the fixed slide rail by means of connecting elements. A lighting device is connected to free ends of the movable slide rails by means of connecting elements. In use, by means of the movable slide rails and the fixed rail that can displace forwardly and rearwardly as well as left and right with respect to a bottom side of a shelf, the lighting device can be pulled outwardly or pushed inwardly or can displace left and right with respect to the bottom side of the shelf to sufficiently illuminate the area beneath the shelf and above a table surface where it is relatively dark.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 2:
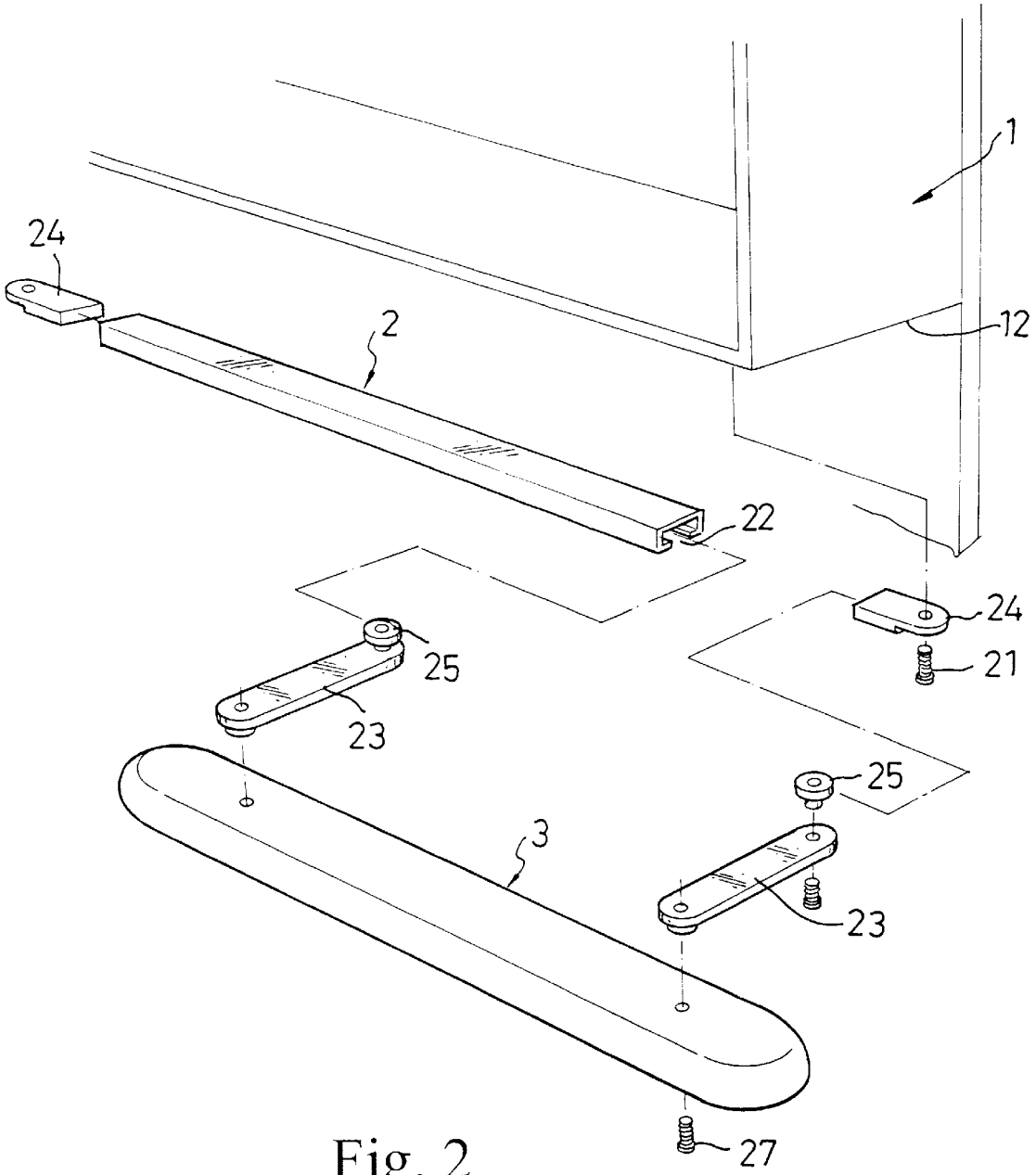
FIG. 2 is an exploded perspective view of the first preferred embodiment of the present invention.

With reference to FIG. 2, a preferred embodiment of an office furniture light structure according to the present invention is shown to include a securing element and a lighting device 3.

The securing element in this embodiment is a securing rail 2 provided on a bottom side 12 of a shelf 1 of a piece of office furniture. The securing rail 2 is provided with a track 22 having two ends. Two movable plates 23 are respectively provided at the ends of the track 22 at suitable positions and extend outwardly therefrom. One end of each of the movable plates 23 is insertably mounted in the track 22 of the securing rail 2 by means of a roller 25. The roller 25 slidably displaces along the track 22 to enable the corresponding movable plate 23 to displace left or right of the track 22. The securing rail 2 is further provided a stop block 24 at either distal end to restrict displacement of the rollers 25 within the space defined by the track 22 between the stop blocks 24 and to thereby prevent slippage of the rollers 25 out of the track 22. The stop blocks 24 are secured on the bottom side 12 of the shelf 1 by means of retaining elements 21. In this embodiment, the retaining elements 21 are screws but, as well known in the art, can be substituted by other elements. The lighting device 3 is pivotally connected to the other end of each of the movable plates 23 on a bottom side. In this embodiment, the lighting device 3 is a fluorescent lamp. The movable plates 23 and the lighting device 3 are movably connected by means of connecting elements 27.

After assembly, by means of the rollers 25 at one end of each of the movable plates 23 that can slidably displace along the track 22 of the securing rail 2, the lighting device 3 can displace left and right of the securing rail 2. Besides, as the movable plates 23 can swing sideways, the lighting device 3 can be pulled outwardly or pushed inwardly with respect to the bottom side 12 of the shelf 1 so that the relatively dark area beneath the shelf 1 and above the table surface 11 is properly illuminated and there is no more shade.

Figure 1:
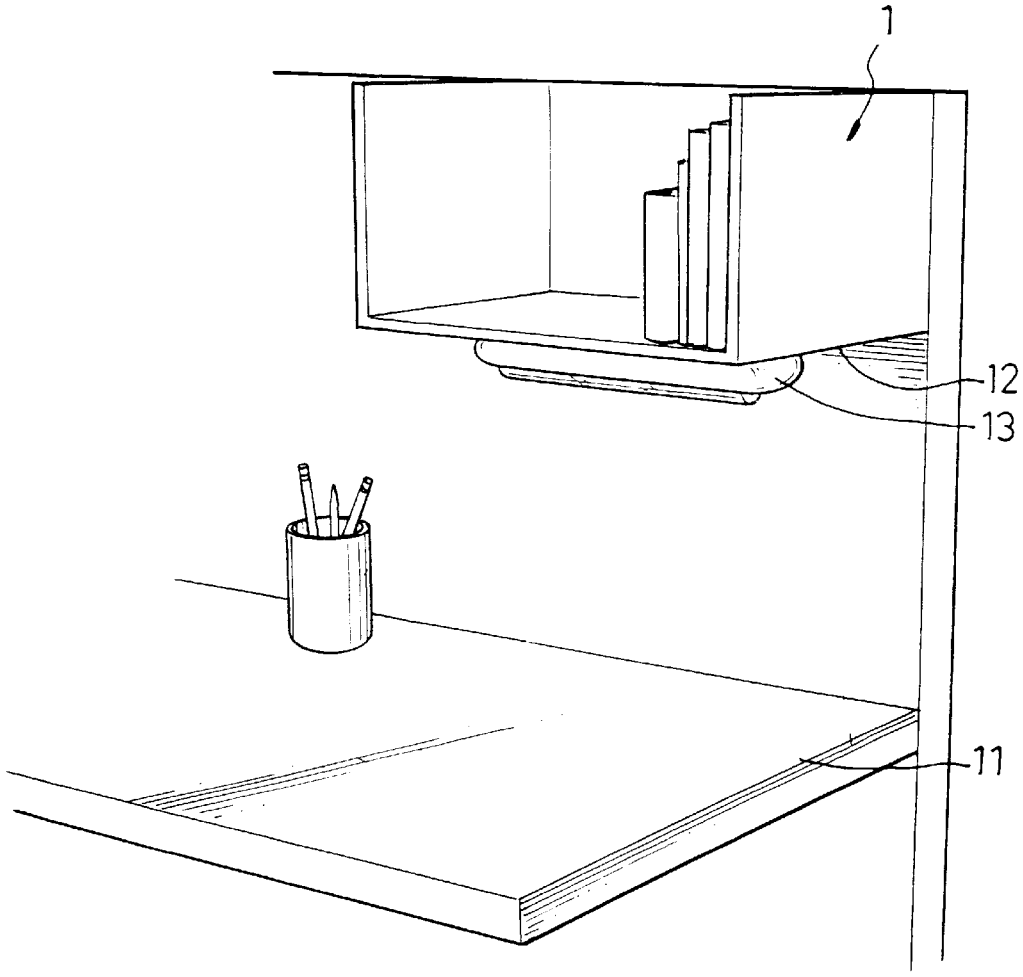
Fig. 1 Prior Art
FIG. 1 is a perspective view of a conventional office furniture light structure.
Figure 3:
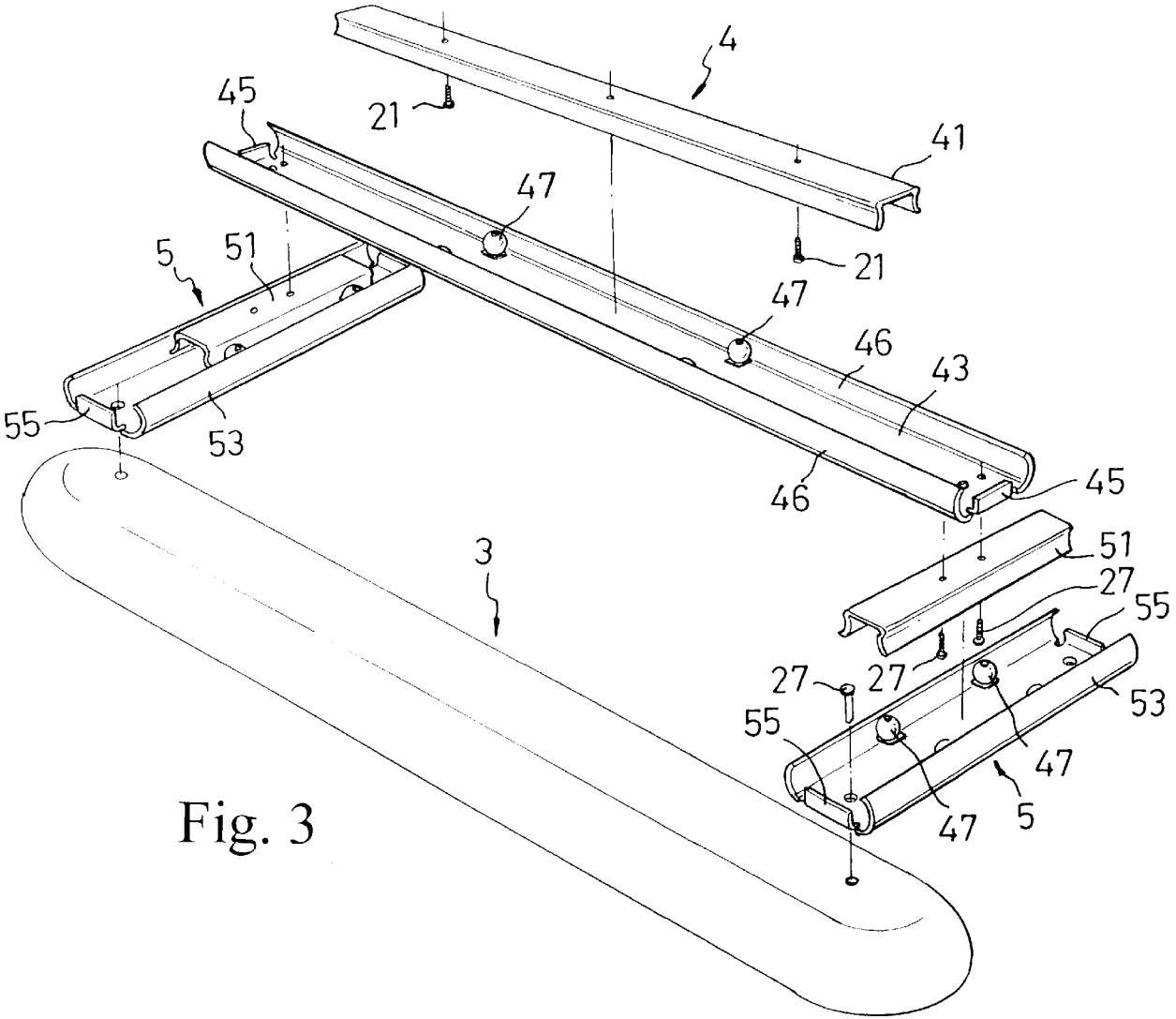
FIG. 3 is an exploded perspective view of the second preferred embodiment of the present invention.
Figure 4:
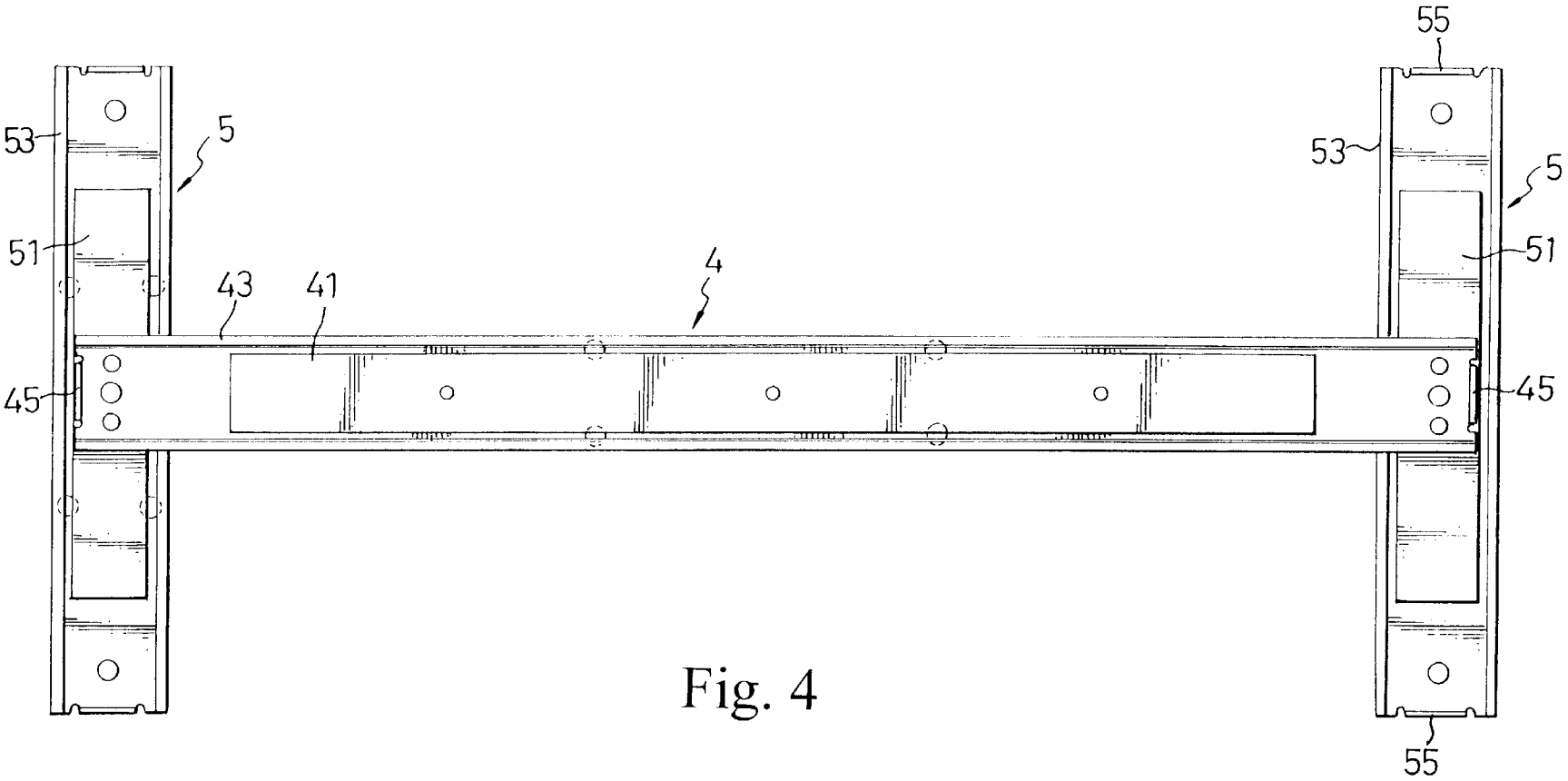
FIG. 4 is a plan schematic view of slide rails of the second preferred embodiment.

FIGS. 3 and 4 show another embodiment of the present invention. In this embodiment, the securing element is a fixed slide rail 4. The fixed slide rail 4 is provided on a bottom side 12 of a shelf 1 (see FIG. 1) and includes an upper slide rail 41 and a lower slide rail 43. The lower slide rail 43 is capable of slidable displacement on the upper slide rail 41. The upper slide rail 41 is secured to the bottom side 12 of the shelf 1 by means of retaining elements 21. In this embodiment, the retaining elements 21 are but not limited to screws. The lower slide rail 43 is provided with an upwardly projecting stop plate 45 at either distal end such that the displacement of the lower slide rail 43 on the upper slide rail 41 is restricted to the space defined by the two stop plates 45.

The lower slide rail 43 is further provided with a plurality of outwardly extending movable slide rails 5 at both ends thereof. The movable slide rails 5 are each provided with upper and lower sliding rails 51, 53, the lower sliding rails 53 being capable of slidably displacement on the upper sliding rails 51. Each upper sliding rail 51 has a substantially central portion connected to a bottom side of the lower slide rail 43 of the fixed slide rail 4 by means of connecting elements 27. Each lower sliding rail 53 has two ends respectively provided with an upwardly projecting stop 55 such that slidable displacement of the lower sliding rail 53 is restricted to the space defined by the projecting stops 55 at both ends. A lighting device 3 is connected to the end of each of the lower sliding rails 53 opposite to the fixed slide rail 4 at a bottom side by means of connecting elements 27. In this embodiment, the lighting device 3 is a fluorescent lamp.

Figure 5:
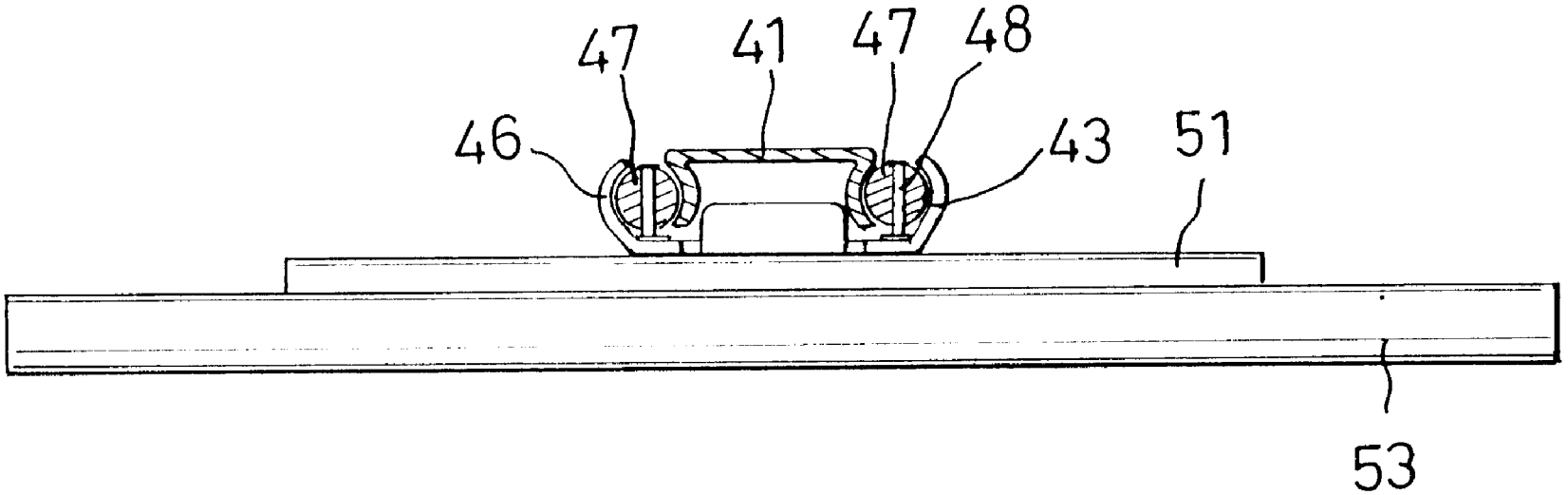
FIG. 5 is a sectional schematic view of the slide rails of the second preferred embodiment.

With reference to FIGS. 4 and 5, the upper and lower slide rails 41, 51, and the upper and lower sliding rails 43, 53 are provided with folded edges 46 on opposed sides thereof. Balls 47 are provided in the folded edges 46. By means of the rolling movement of the balls 47, the lower slide rail 43 and the lower sliding rail 53 can slidably displace on the upper slide rail 41 and the upper sliding rail 51, respectively. Between the folded edges 46 on the side of the adjacent balls 47, there are provided securing frame blocks 48 such that the upper and lower slide rails 41, 43 can be movably connected and that the upper and lower sliding rails 51, 53 can be movably connected.

After assembly, by means of the lower sliding rail 53 that displaces left and right on the upper sliding rail 51 and by means of the lower slide rail 43 that displaces left and right on the upper slide rail 41, the lighting device 3 can be pulled outwardly or pushed inwardly or can displace leftward or rightward with respect to the bottom side 12 of the shelf 1 so that the area beneath the shelf 1 and above the table surface 11 can be sufficiently illuminated.

Although the present invention has been illustrated an described with reference to the preferred embodiment thereof, it should be understood that it is in no way limited to the details of such embodiment but is capable of numerous modifications within the scope of the appended claims.

What is claimed is:

1. An office furniture light structure, comprising:

a securing rail, being adapted to be secured on a bottom side of a shelf of a piece of office furniture, said securing rail being provided with a track;

at least one movable plate that has one end insertably disposed in said track by means of a roller, a lighting device being pivotally connected to the other end of said movable plate on a bottom side distal to said securing rail, whereby said roller can displace within said track of said securing rail to enable said lighting device to displace left or right or to enable said lighting device to swing sideways so that said lighting device can be pulled outwardly or inwardly with respect to said bottom side of said shelf so that a relatively dark area beneath said shelf above a table surface can be sufficiently illuminated.

2. An office furniture lighting structure, comprising:

a fixed slide rail, said fixed slide rail including upper and lower slide rails, said upper slide rail being adapted to be secured on a bottom side of a shelf of a piece of office furniture, said upper and lower slide rails being movably connected;

at least one movable slide rail that is provided on said fixed slide rail and includes upper and lower sliding rails, said upper sliding rail having a substantially central portion connected to a bottom side of said lower slide rail of said fixed rail, a lighting device being connected to the end of said lower sliding rail distal to said fixed slide rail on a bottom side; whereby said lighting device can be pulled outwardly or pushed inwardly or can displace leftward or rightward with respect to said bottom side of said shelf so that a relatively dark area beneath said shelf and above a table surface can be sufficiently illuminated.

3. The office furniture light structure as defined in claim 1, wherein said securing rail has two ends provided with two stop blocks, respectively, such that displacement of said roller along said track is restricted to a space defined by said stop blocks and said roller is prevented from slippage.

4. The office furniture light structure as defined in claim 1 or 2, wherein said lighting device is a fluorescent lamp.

5. The office furniture light structure as defined in claim 2, wherein said upper and lower slide rails and said upper and lower sliding rails are each provided with folded edges on opposed sides thereof, balls being disposed in each of said folded edges such that said lower slide rail and said lower sliding rail can slidably displace on said upper slide rail and said upper sliding rail, respectively, by means of said balls, a securing frame block being provided between opposed folded edges between adjacent balls to enable said upper and lower slide rails and said upper and lower sliding rails to be movably and insertably connected.

6. The office furniture light structure as defined in claim 2 or 5, wherein said lower slide rail and said lower sliding rail are each provided with an outwardly projecting stop plate at either end such that displacement of said lower slide rail on said upper slide rail and displacement of said lower sliding rail on said upper sliding rail is restricted to a space defined by the corresponding stop plates thereof.

* * * * *